US008324994B2

(12) United States Patent
Naka et al.

(10) Patent No.: US 8,324,994 B2
(45) Date of Patent: Dec. 4, 2012

(54) RIVERSIBLE ELECTROMAGNETIC CONTACTOR

(75) Inventors: Yasuhiro Naka, Kounosu (JP); Toshikatsu Ohgami, Kounosu (JP); Koji Okubo, Kumagaya (JP); Kouetsu Takaya, Kounosu (JP); Kenji Suzuki, Kounosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/322,035

(22) PCT Filed: Jun. 14, 2010

(86) PCT No.: PCT/JP2010/003938
§ 371 (c)(1),
(2), (4) Date: Jan. 10, 2012

(87) PCT Pub. No.: WO2011/021336
PCT Pub. Date: Feb. 24, 2011

(65) Prior Publication Data

US 2012/0133461 A1 May 31, 2012

(30) Foreign Application Priority Data

Aug. 20, 2009 (JP) ..... 2009-190589

(51) Int. Cl.
*H01H 67/02* (2006.01)

(52) U.S. Cl. ..... 335/132

(58) Field of Classification Search ..... 335/132
See application file for complete search history.

(56) References Cited

U.S. PATENT DOCUMENTS

| | | | | |
|---|---|---|---|---|
| 4,345,225 | A * | 8/1982 | Lemmer | 335/132 |
| 5,081,436 | A * | 1/1992 | Nishi et al. | 335/83 |
| 5,347,250 | A * | 9/1994 | Muske | 335/132 |
| 5,677,655 | A * | 10/1997 | Hinata et al. | 335/132 |
| 7,091,805 | B2 * | 8/2006 | Kawahara et al. | 335/132 |

FOREIGN PATENT DOCUMENTS

| | | |
|---|---|---|
| JP | S61-10822 | 1/1986 |
| JP | H03-266325 | 11/1991 |
| JP | H03-266326 | 11/1991 |
| JP | H0-076719 | 3/1994 |

* cited by examiner

*Primary Examiner* — Elvin G Enad
*Assistant Examiner* — Alexander Talpalatski
(74) *Attorney, Agent, or Firm* — Manabu Kanesaka

(57) ABSTRACT

An electromagnetic contactor (1*a*) is provided with an erroneous mounting prevention unit (8) which permits an entry of a connection piece when a connection piece (6*f*) of a reversible unit (6) attempts to enter a normal position (NP) inside a display window (3*a*) where the connection piece is connectable to an operation display piece (4*a*), and prevents the entry of the connection piece when the connection piece attempts to enter a position inside the display window (3*a*) deviated from the normal position (NP).

4 Claims, 8 Drawing Sheets

Fig. 5
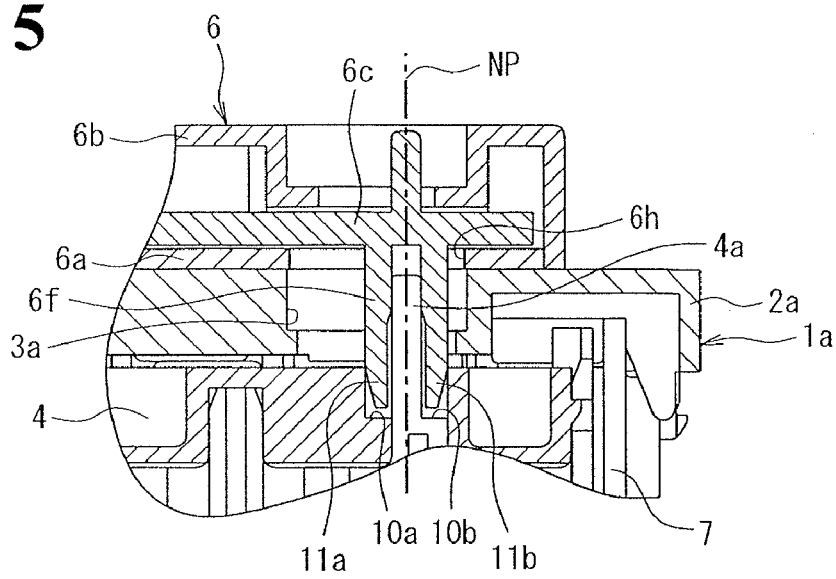
Fig. 6(a)
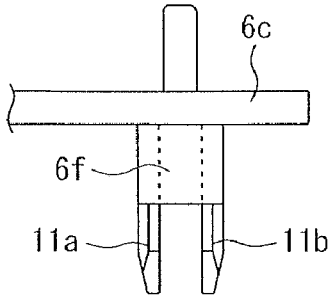
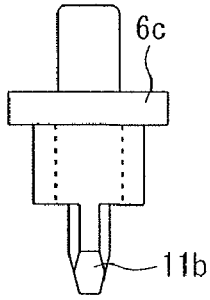
Fig. 6(b)
Fig. 6(c)
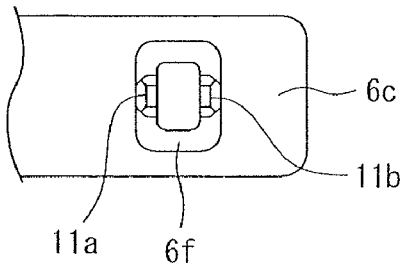

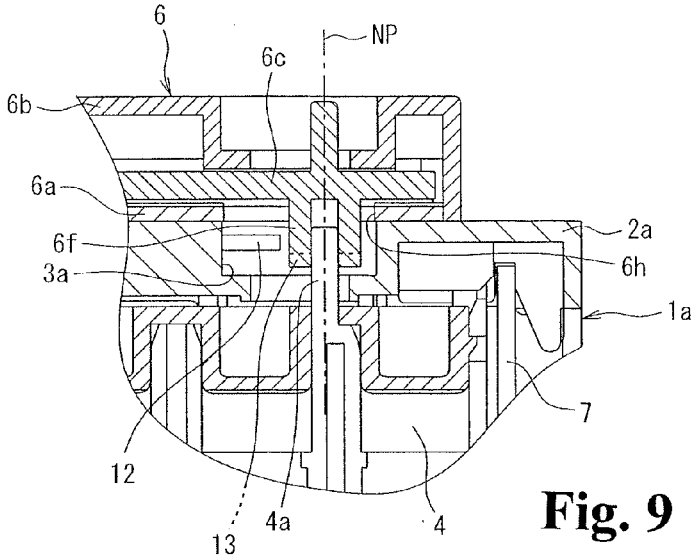
Fig. 9
Fig. 10(a)
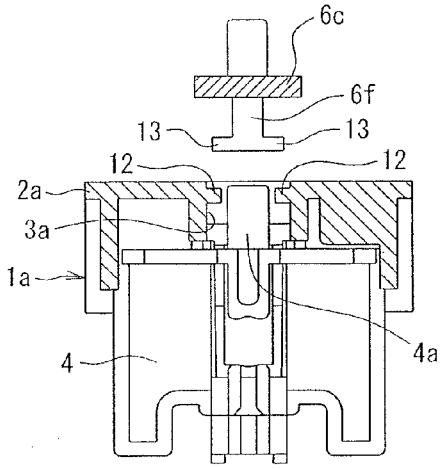
Fig. 10(b)
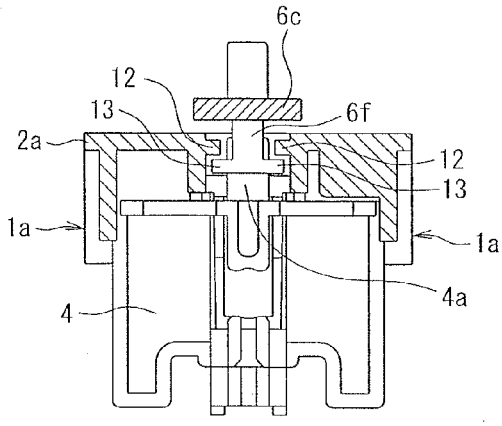

RIVERSIBLE ELECTROMAGNETIC CONTACTOR

RELATED APPLICATIONS

The present application is National Phase of International Application No. PCT/JP2010/003938 filed Jun. 14, 2010, and claims priority from, Japanese Application No. 2009-190589, filed Aug. 20, 2009.

TECHNICAL FIELD

The present invention relates to a reversible electromagnetic contactor in which a reversible unit is mounted over two electromagnetic contactors disposed adjacent to each other.

BACKGROUND ART

As a reversible electromagnetic contactor that is connected to a power feeding circuit of an induction motor and performs a normal and reverse operation control of the induction motor, there is known a device in which a reversible unit is mounted so as to extend over two electromagnetic contactors disposed adjacent to each other and mechanically locks the operation in which two electromagnetic contactors simultaneously enter a closed-circuit (ON) state (for example, Patent Document 1).

FIGS. 11 to 14 specifically illustrate a conventional reversible electromagnetic contactor.

As shown in FIG. 11, two electromagnetic contactors 1*a* and 1*b* disposed adjacent to each other have a structure in which display windows 3*a* and 3*b* are respectively provided in arc-extinguishing covers 2*a* and 2*b* and operation display pieces 4*a* and 4*b* are respectively provided inside the display windows 3*a* and 3*b* to protrude from the inside of the device.

As shown in FIG. 12, the operation display piece 4*a* of one electromagnetic contactor 1*a* is a member which is fixed to a movable contact support 4 disposed inside the electromagnetic contactor 1*a* and extends toward the inside of the display window 3*a*. Then, the operation display piece may check an operation of the movable contact support 4 since the position of the operation display piece 4*a* changes inside the display window 3*a* as well as a closed-circuit (ON) operation and an opened-circuit (OFF) operation of the movable contact support 4. Further, since the position of the operation display piece 4*b* of the other electromagnetic contactor 1*b* also changes inside the display window 3*b*, a closed-circuit (ON) operation and an opened-circuit (OFF) operation of a movable contact support (not shown) disposed inside the electromagnetic contactor 1*b* may be checked.

As shown in FIG. 11, a reversible unit 6 includes a unit bottom plate 6*a* which is connected to the arc-extinguishing covers 2*a* and 2*b* in such a state as to extend over two electromagnetic contactors 1*a* and 1*b* and a unit cover 6*b*, a peripheral edge portion of which engages a peripheral edge of the unit bottom plate 6*a*, where in the internal space of the unit bottom plate 6*a* and the unit cover 6*b*, first and second rotation plates 6*c* and 6*d* are rotatably connected to a rotation regulation member 6*e*. Further, cylindrical connection pieces 6*f* and 6*g* are respectively formed at the end portions of the first rotation plate 6*c* and the second rotation plate 6*d* to protrude outward through open portions 6*h* and 6*i* formed in the bottom plate 6*a*. Then, a plurality of hook portions 6*j* is formed at the unit bottom plate 6*a*, and a plurality of engagement holes 2*c* is formed in the arc-extinguishing covers 2*a* and 2*b* to correspond to the hook portions 6*j*. When the unit bottom plate 6*a* contacts the arc-extinguishing covers 2*a* and 2*b*, the plurality of hook portions 6*j* detachably engages with the corresponding engagement holes 2*c*.

Then, when the connection pieces 6*f* and 6*g* of the reversible unit 6 are fitted to the head portions of the operation display pieces 4*a* and 4*b* of two electromagnetic contactors 1*a* and 1*b* as shown in FIG. 13, the rotation regulation member 6*e* rotates one of the first rotation plate 6*c* and the second rotation plate 6*d*, restricts the rotation of the other thereof, permits the movement of only one of the operation display pieces 4*a* and 4*b*, and thus mechanically locks the operation in which two electromagnetic contactors 1*a* and 1*b* simultaneously enter a closed-circuit (ON) state.

CITATION LIST

Patent Document

Patent Document 1: Japanese Patent Application Laid-Open No. 03-266325

DISCLOSURE OF THE INVENTION

Problems to be Solved by the Invention

However, the reversible unit 6 does not include a holding member such as a spring member that holds the initial positions of the connection pieces 6*f* and 6*g* in order to reduce a load applied thereto when the reversible unit is connected to the electromagnetic contactors 1*a* and 1*b*. For this reason, when mounting the reversible unit 6 so as to extend over two electromagnetic contactors 1*a* and 1*b*, as shown in FIG. 14, if the connection piece 6*f* protruding from the open portion 6*h* and the initial position of which is not set is deviated from a normal position where the connection piece is connectable to the operation display piece 4*a*, there is a concern that the reversible unit 6 is mounted onto the electromagnetic contactors 1*a* and 1*b* while the connection piece 6*f* is not connected to the operation display piece 4*a*. Furthermore, although not shown in the drawings, when mounting the reversible unit 6, the other connection piece 6*g* may not be connected to the operation display piece 4*b* in some cases.

Therefore, the invention is made in view of the problems to be solved in the above-mentioned conventional example, and an object thereof is to provide a reversible electromagnetic contactor capable of preventing an erroneous mounting of a reversible unit by preventing the mounting of the reversible unit onto two electromagnetic contactors when a connection piece is not properly connected to an operation display piece.

Means for Solving the Problems

In order to attain the above-described object, a reversible electromagnetic contactor according to an embodiment includes a pair of electromagnetic contactors disposed adjacent to each other and a reversible unit mounted over the electromagnetic contactors. The pair of electromagnetic contactors includes a movable contact support accommodated inside a body casing and an operation display piece fixed to the movable contact support and protruding toward a display window provided in a unit mounting portion of the body casing. The reversible unit allows a pair of connection pieces, initial positions of which are not held, to enter the display window so that they are respectively connected to the operation display pieces. An erroneous mounting prevention unit is provided in at least one of the electromagnetic contactors or the connection pieces to permit an entry of the connection piece when the connection piece attempts to enter a normal position inside the display window where the connection piece is connectable to the operation display piece, and to prevent the entry of the connection piece when the connection piece attempts to enter a position inside the display window deviated from the normal position.

In the reversible electromagnetic contactor according to the embodiment, the mounting of the reversible unit to the pair of electromagnetic contactors is prevented when the connection piece is not properly connected to the operation display piece, thereby preventing the erroneous mounting of the reversible unit.

Further, in the reversible electromagnetic contactor according to an embodiment, the erroneous mounting prevention unit is an entry regulation unit which is provided in a portion of the movable contact support facing the display window. The entry regulation unit does not contact the connection piece when the connection piece attempts to enter the normal position inside the display window, and contacts the connection piece to prevent the entry thereof when the connection piece attempts to enter a position deviated from the normal position.

In the reversible electromagnetic contactor according to the embodiment, the entry regulation portion formed in the movable contact support prevents the movement of the reversible unit having the connection piece of which the initial position is not held when the connection piece attempts to enter the display window from a position other than the normal position, thereby reliably preventing a state where the connection piece is not properly connected to the operation display piece.

Further, in the reversible electromagnetic contactor according to an embodiment, the erroneous mounting prevention unit includes a concave portion which is provided in the movable contact support around the operation display piece and a convex portion which is provided in a front end of the connection piece. When the connection piece attempts to enter the normal position inside the display window, the convex portion enters the concave portion to permit the mounting of the reversible unit onto the unit mounting portion. When the connection piece attempts to enter a position deviated from the normal position, the convex portion contacts the movable contact support other than the concave portion to prevent the mounting of the reversible unit onto the unit mounting portion.

In the reversible electromagnetic contactor according to the embodiment, the concave portion provided in the movable contact support and the convex portion provided in the front end of the connection piece prevent the movement of the reversible unit having the connection piece of which the initial position is not held when the connection pieces attempts to enter the display window from a position other than the normal position, thereby reliably preventing a state where the connection piece is not properly connected to the operation display piece.

Further, in the reversible electromagnetic contactor according to an embodiment, the erroneous mounting prevention unit includes a first engagement entry regulation portion which is provided in a part of an inner wall forming the display window and a second engagement entry regulation portion which is provided in a front end of the connection piece to protrude outward. When the connection piece attempts to enter the normal position inside the display window, the first and second engagement entry regulation portions do not engage with each other to permit the mounting of the reversible unit onto the unit mounting portion. When the connection piece attempts to enter a position deviated from the normal position, the first and second engagement entry regulation portions engage with each other to prevent the mounting of the reversible unit onto the unit mounting portion.

In the reversible electromagnetic contactor according to the embodiment, the first engagement entry regulation portion provided in a part of the inner wall provided with the display window and the second engagement entry regulation portion provided in the front end of the connection piece to protrude outward prevent the movement of the reversible unit having the connection piece of which the initial position is not held when the connection piece attempts to enter the display window from a position other than the normal position, thereby reliably preventing a state where the connection piece is not properly connected to the operation display piece.

Effects of the Invention

According to the reversible electromagnetic contactor of the invention, the mounting of the reversible unit onto the pair of electromagnetic contactors may not be permitted when the connection piece is not properly connected to the operation display piece, and the erroneous mounting of the reversible unit may be reliably prevented.

BRIEF DESCRIPTION OF THE DRAWINGS

FIG. 5 is a diagram illustrating a state where the connection piece of the reversible unit of the second embodiment is held at the normal position and is connected to an operation display piece.

FIG. 6 is a diagram illustrating a shape of the connection piece of the second embodiment.

FIG. 9 is a diagram illustrating a state where the connection piece of the reversible unit of the third embodiment is held at the normal position and is connected to an operation display piece.

FIG. 10 is a diagram illustrating an internal structure of the reversible electromagnetic contactor of the third embodiment when seen from a direction in which a movable contact support is driven.

BEST MODE FOR CARRYING OUT THE INVENTION

Figure 1:
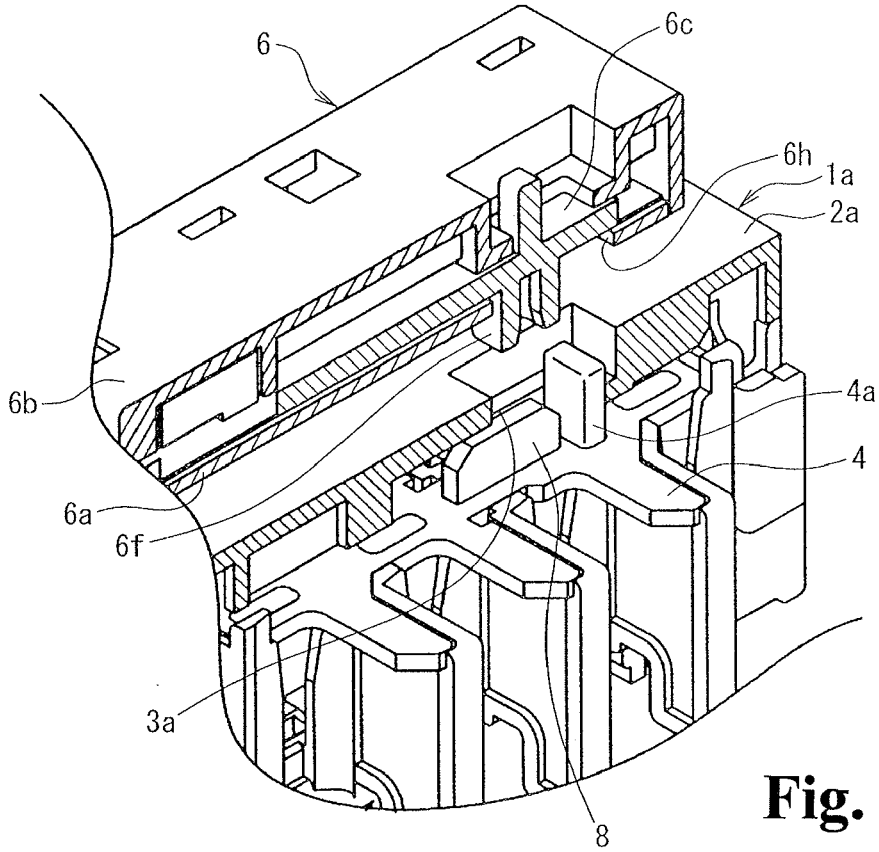
FIG. 1 is a perspective view illustrating a main part of a reversible electromagnetic contactor of a first embodiment of the invention.

Hereinafter, a best mode for carrying out the invention (hereinafter, referred to as an embodiment) for a reversible electromagnetic contactor according to the invention will be described in detail by referring to the drawings. Furthermore, the same reference numerals will be given to the same components as those of FIGS. 11 to 14, and the description thereof will not be repeated.

Figure 11:
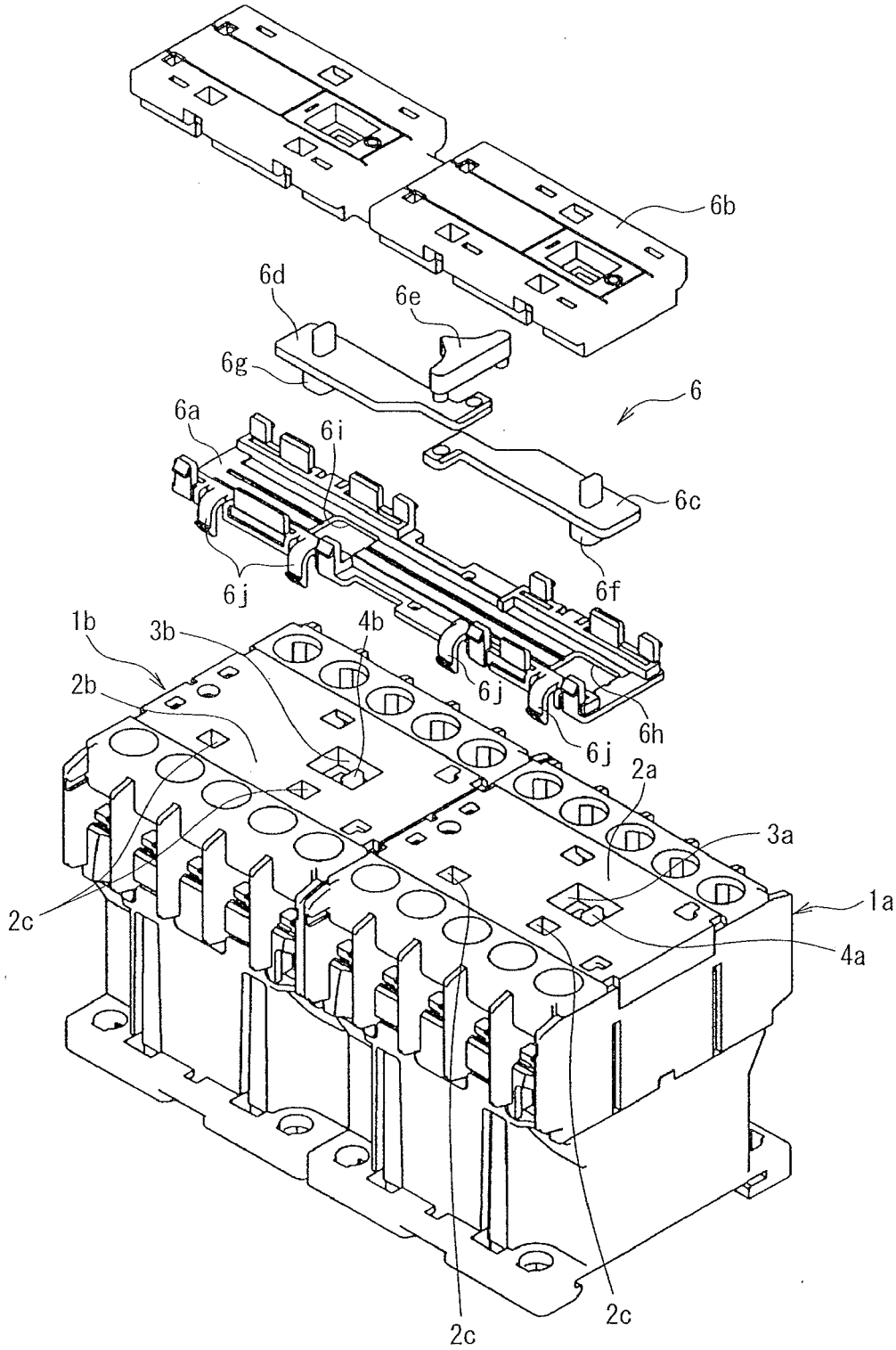
Fig. 11 Prior Art
FIG. 11 is an exploded perspective view illustrating a conventional reversible electromagnetic contactor.
Figure 12:
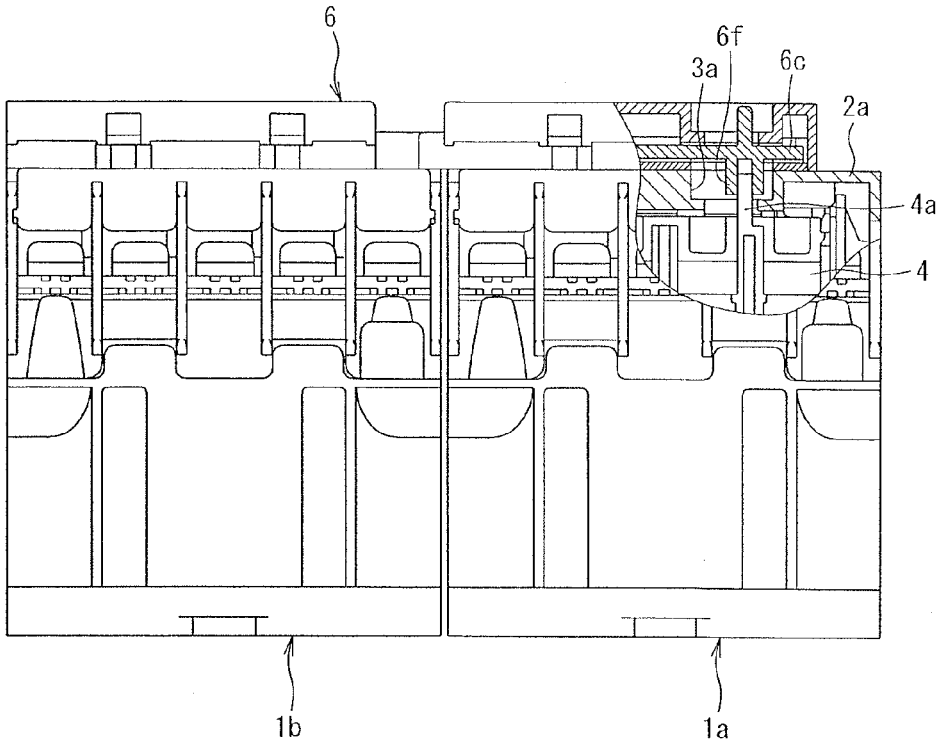
Fig. 12 Prior Art
FIG. 12 is a cross-sectional view of the conventional reversible electromagnetic contactor shown from a side portion.
Figure 13:
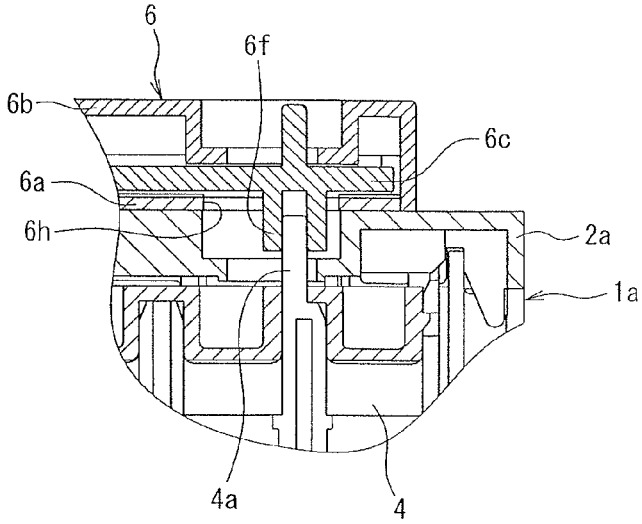
Fig. 13 Prior Art
FIG. 13 is a diagram illustrating a state where a connection piece of a reversible unit of the conventional reversible electromagnetic contactor is held at a normal position and is connected to an operation display piece.
Figure 14:
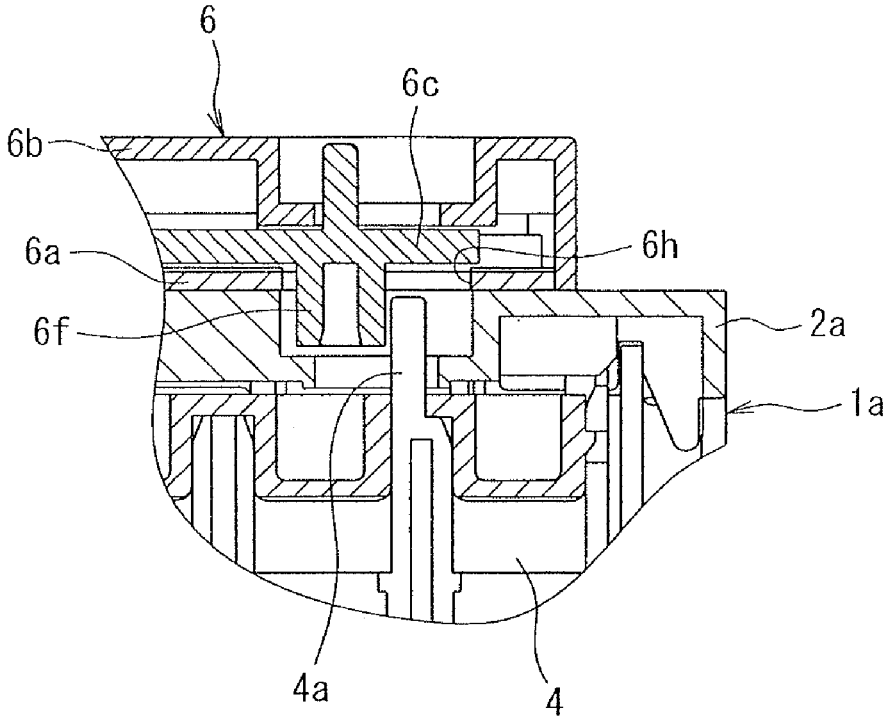
Fig. 14 Prior Art
FIG. 14 is a diagram illustrating a state where the connection piece of the reversible unit of the conventional reversible electromagnetic contactor is not held at the normal position.

In the respective embodiments to be described below, as in FIG. 11, two electromagnetic contactors 1*a* and 1*b* are disposed adjacent to each other, and a reversible unit 6 is mounted over the electromagnetic contactors 1*a* and 1*b*. However, only the mounted portion of one electromagnetic contactor 1*a* and the reversible unit 6 is shown.

First Embodiment

Figure 2:
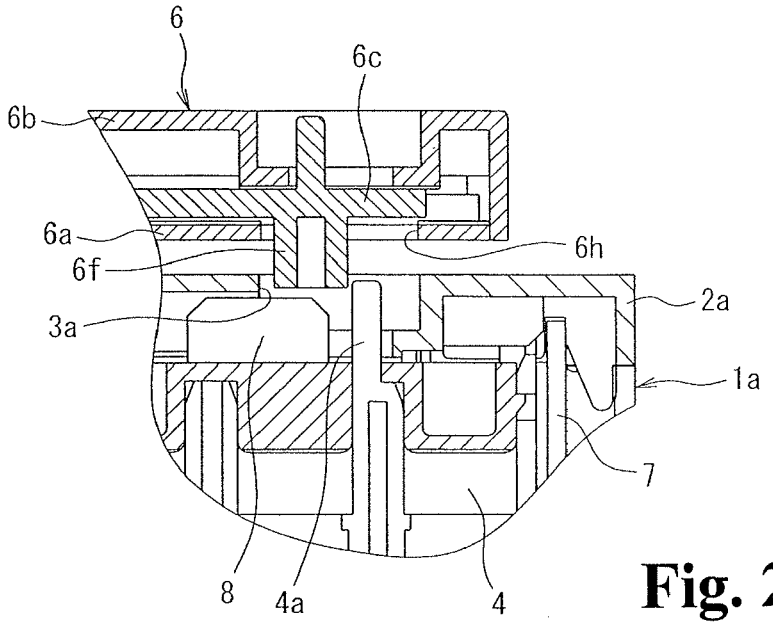
FIG. 2 is a diagram illustrating a state where a connection piece of a reversible unit of the first embodiment is not held at a normal position.
Figure 3:
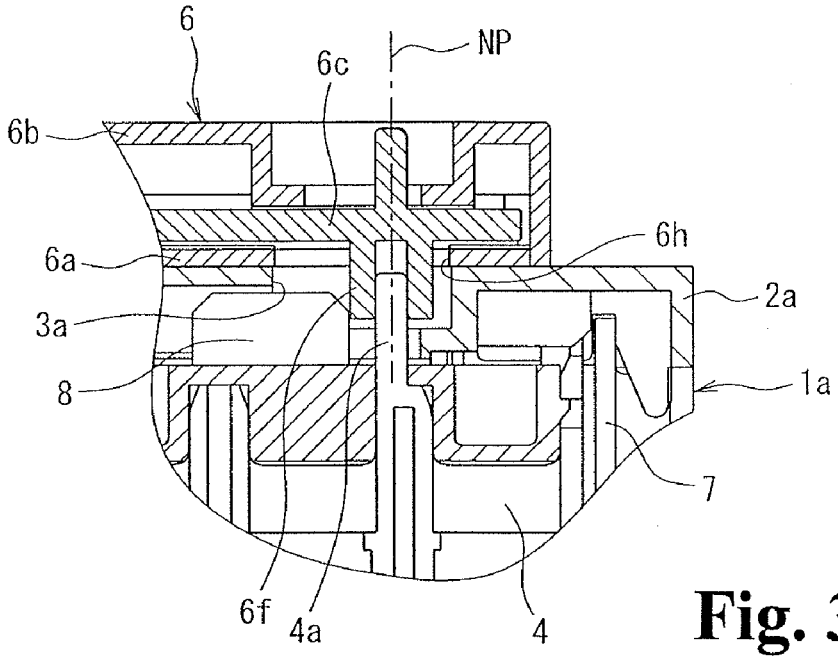
FIG. 3 is a diagram illustrating a state where the connection piece of the reversible unit of the first embodiment is held at the normal position and is connected to an operation display piece.

FIGS. 1 to 3 illustrate a reversible electromagnetic contactor of a first embodiment. A movable contact support 4 of one electromagnetic contactor 1*a* includes a plurality of movable contacts (not shown), and faces a plurality of fixed contacts disposed inside the electromagnetic contactor 1*a*. Further, an electromagnet is accommodated inside the electromagnetic contactor 1*a* to be parallel to the movable contact support 4, and a movable core of the electromagnet and the movable contact support 4 are connected to each other via a drive lever 7. Then, when an excitation coil of the electromagnet is excited, the movable core is driven, and the drive of the movable core is transmitted to the movable contact support 4 via the drive lever 7, whereby the open and close operation of the plurality of movable and fixed contacts corresponding to each other is performed.

Here, as shown in FIG. 1, the movable contact support 4 of the embodiment has a structure in which an entry regulation portion 8 is formed at a position adjacent to the operation display piece 4*a* to protrude toward a display window 3*a*.

The entry regulation portion 8 permits the entry of a connection piece 6*f* toward the display window 3*a* when the connection piece 6*f* of the reversible unit 6 is located at a normal position NP where it may be fitted to the operation display piece 4*a* as shown in FIG. 3. The entry regulation portion 8 prevents the entry of the connection piece 6*f* toward the display window 3*a* by contacting the front end of the connection piece when the connection piece 6*f* attempts to enter the display window 3*a* from a position deviated from the normal position NP as shown in FIG. 2.

Further, an entry regulation portion 8 is also formed at a position adjacent to an operation piece 4*b* of the movable contact support 4 of the other electromagnetic contactor 1*b* to protrude toward a display window 3*b*. The entry regulation portion 8 permits the entry of a connection piece 6*g* toward the display window 3*b* when the connection piece 6*g* of the reversible unit 6 is located at the normal position NP where it may be fitted to the operation display piece 4*b*. The entry regulation portion 8 prevents the entry of the connection piece 6*g* toward the display window 3*b* by contacting the front end of the connection piece when the connection piece 6*g* attempts to enter the display window 3*b* from a position deviated from the normal position NP.

Furthermore, a unit mounting portion of the invention corresponds to arc-extinguishing covers 2*a* and 2*b*.

According to the above-described configuration, when any one of the connection pieces 6*f* and 6*g* protruding from open portions 6*h* and 6*i* of the reversible unit 6 is not located at the normal position NP where the connection pieces are connectable to the operation display pieces 4*a* and 4*b* of the movable contact support 4, the entry regulation portion 8 provided at a position adjacent to the operation display pieces 4*a* and 4*b* prevents the entry of the connection pieces 6*f* and 6*g* toward the display windows 3*a* and 3*b* as shown in FIG. 2, so that the reversible unit 6 may not be mounted onto the electromagnetic contactor 1*a*. On the other hand, in the reversible unit 6 allowing the connection pieces 6*f* and 6*g* to be located at the normal position NP as shown in FIG. 3, the connection pieces 6*f* and 6*g* enter the display windows 3*a* and 3*b* without being prevented by the entry regulation portion 8 to be fitted to the operation display pieces 4*a* and 4*b*, and a unit bottom plate 6*a* contacts the arc-extinguishing covers 2*a* and 2*b* so that a hook portion 6*j* and an engagement hole 2*c* engage with each other, whereby the reversible unit may be mounted onto the electromagnetic contactor 1*a*.

Accordingly, in the embodiment, the entry regulation portion 8 formed in the movable contact support 4 prevents the reversible unit 6 having the connection pieces 6*f* and 6*g* of which the initial positions are not held when the connection pieces 6*f* and 6*g* attempt to enter the display windows 3*a* and 3*b* from a position other than the normal position NP, thereby reliably preventing a state where the connection pieces 6*f* and 6*g* are not normally connected to the operation display pieces 4*a* and 4*b*.

Further, in the embodiment, since the mounting of the reversible unit 6 to two electromagnetic contactors 1*a* and 1*b* is not permitted while the connection pieces 6*f* and 6*g* of the reversible unit 6 are not normally connected to the operation display pieces 4*a* and 4*b*, a reversible electromagnetic contactor preventing an erroneous mounting of the reversible unit 6 may be provided.

Then, since the erroneous mounting of the reversible unit 6 is prevented, the safety of the reversible electromagnetic contactor performing a normal and reverse operation control of an induction motor may be reliably improved.

Second Embodiment

Figure 4:
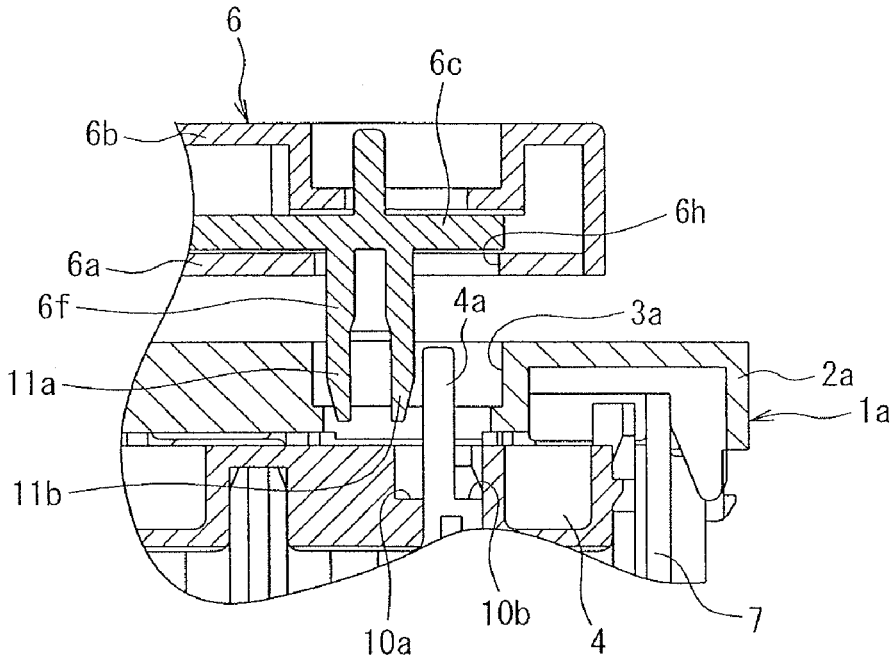
FIG. 4 is a diagram illustrating a state where a connection piece of a reversible unit of a second embodiment of the invention is not held at a normal position.

Next, FIGS. 4 to 6 illustrate a reversible electromagnetic contactor of a second embodiment.

In the embodiment, as shown in FIG. 4, concave portions 10*a* and 10*b* are formed at two positions of a surface facing the display window 3*a* in the movable contact support 4. The concave portions 10*a* and 10*b* are formed around the operation display piece 4*a*.

Further, a pair of convex portions 11*a* and 11*b* is formed at the lower end of the connection piece 6*f* of the reversible unit 6, and the pair of convex portions 11*a* and 11*b* is formed to extend in parallel to each other as shown in FIG. 6.

In the embodiment, when the connection piece 6*f* of the reversible unit 6 is located at the normal position NP where it may be fitted to the operation display piece 4*a* as shown in FIG. 5, the unit bottom plate 6*a* contacts the arc-extinguishing covers 2*a* and 2*b*, and the hook portion 6*j* and the engagement hole 2*c* engage with each other while the front ends of the pair of convex portions 11*a* and 11*b* formed at the lower end of the connection piece 6*f* are inserted into the concave portions 10*a* and 10*b* formed around the operation display piece 4*a*, whereby the reversible unit may be mounted onto the electromagnetic contactor 1*a*.

On the other hand, when the connection piece 6*f* attempts to enter the display window 3*a* from a position deviated from the normal position NP as shown in FIG. 4, the convex portions 11*a* and 11*b* of the connection piece 6*f* contact a surface without the concave portions 10*a* and 10*b* in the movable contact support 4, and the unit bottom plate 6*a* is spaced from the arc-extinguishing covers 2*a* and 2*b*, whereby the reversible unit 6 may not be mounted onto the electromagnetic contactor 1*a*.

Further, although not shown in the drawings, concave portions 10*a* and 10*b* having the same structure are also formed at two positions of a surface facing the display window 3*a* in the movable contact support 4 of the other electromagnetic contactor 1*b*, and a pair of convex portions 11*a* and 11*b* having the same structure is also formed at the lower end of the connection piece 6*g* of the reversible unit 6, thereby obtaining the same effect.

Accordingly, even in the embodiment, the concave portions 10*a* and 10*b* formed at two positions of the movable contact supports 4 of the electromagnetic contactors 1*a* and 1*b* and the pair of convex portions 11*a* and 11*b* formed at the lower ends of the connection pieces 6*f* and 6*g* of the reversible unit 6 prevents the movement of the reversible unit 6 having the connection pieces 6*f* and 6*g* of which the initial positions are not held when the connection pieces 6*f* and 6*g* attempt to enter the display windows 3*a* and 3*b* from a position other than the normal position NP, thereby reliably preventing a state where the connection pieces 6*f* and 6*g* are not normally connected to the operation display pieces 4*a* and 4*b*.

Further, in the embodiment, since the mounting of the reversible unit 6 to two electromagnetic contactors 1*a* and 1*b* is not permitted while the connection pieces 6*f* and 6*g* of the reversible unit 6 are not normally connected to the operation display pieces 4*a* and 4*b*, a reversible electromagnetic contactor preventing an erroneous mounting of the reversible unit 6 and improving the safety may be provided.

Third Embodiment

Further, FIGS. 7 to 10 illustrate a reversible electromagnetic contactor of a third embodiment.

Figure 7:
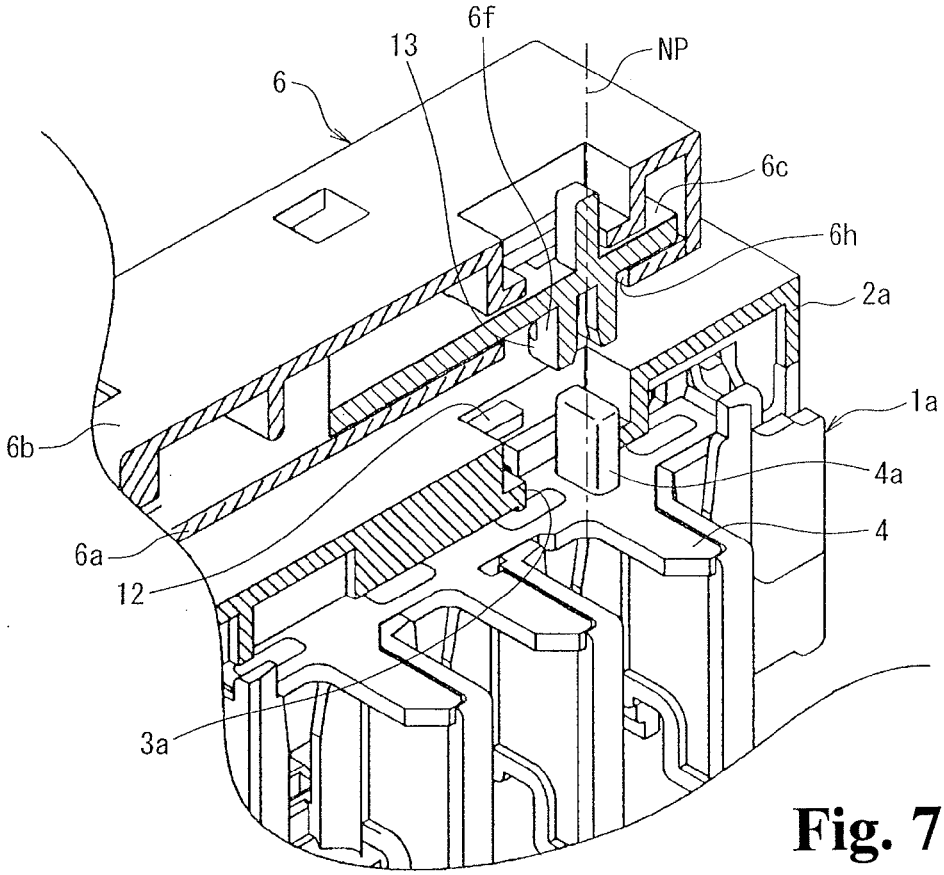
FIG. 7 is a perspective view illustrating a main part of a reversible electromagnetic contactor of a third embodiment of the invention.

In the embodiment, as shown in FIG. 7, a first engagement entry regulation portion 12 is formed in a protruding manner in an inner wall provided with the display window 3*a* in the electromagnetic contactor 1*a*. The first engagement entry regulation portion 12 is formed only at an inner wall of the display window 3*a* deviated from the normal position NP where the connection piece 6*f* of the reversible unit 6 may be fitted to the operation display piece 4*a*.

As shown in FIG. 10(*a*), a second engagement entry regulation portion 13 is formed at the lower portion of the connection piece 6*f* of the reversible unit 6 to protrude outward, and the second engagement entry regulation portion 13 prevents the entry of the connection piece 6*f* while engaging with the first engagement entry regulation portion 12 when the connection piece 6*f* attempts to enter from a position deviated from the normal position NP of the display window 3*a*.

Further, although not shown in the drawings, a first engagement entry regulation portion 12 is also formed in a protruding manner in an inner wall deviated from the normal position NP of the display window 3*b* of the other electromagnetic contactor 1*b*. Then, a second engagement entry regulation portion 13 is also formed in the lower portion of the connection piece 6*g* of the reversible unit 6 to protrude outward, and prevents the entry of the connection piece 6*g* while engaging with the first engagement entry regulation portion 12 formed in the display window 3*b* when the connection piece 6*g* attempts to enter from a position deviated from the normal position NP of the display window 3*b*.

Figure 8:
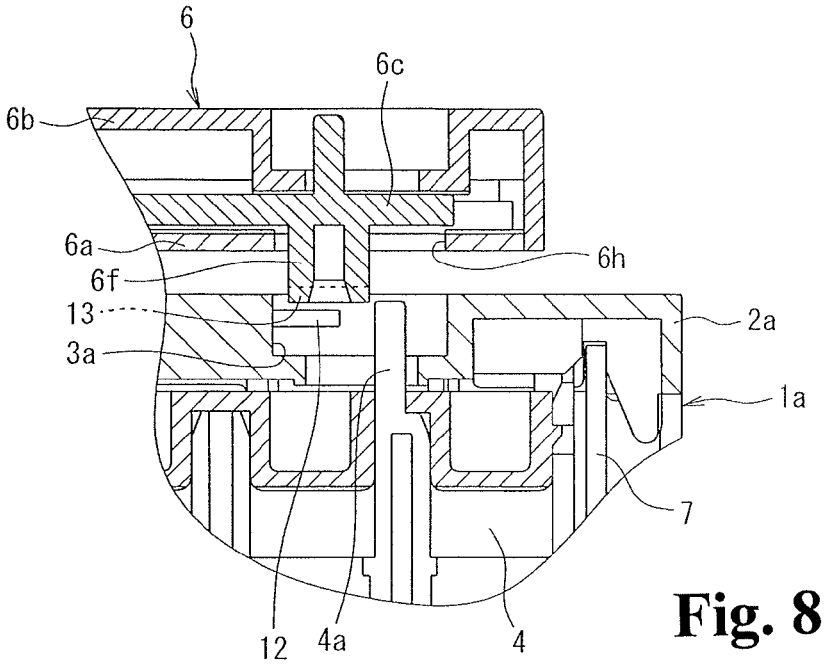
FIG. 8 is a diagram illustrating a state where a connection piece of a reversible unit of the third embodiment is not held at a normal position.

According to the above-described configuration, when any one of the connection pieces 6*f* and 6*g* protruding from the open portions 6*h* and 6*i* of the reversible unit 6 is located at a position deviated from the normal position NP where the connection pieces are connectable to the operation display pieces 4*a* and 4*b* of the movable contact support 4 as shown in FIG. 8, the first engagement entry regulation portions 12 protruding from the inner walls of the display windows 3*a* and 3*b* and the second engagement entry regulation portion 13 protruding from the lower portions of the connection pieces 6*f* and 6*g* engage with each other to prevent the entry of the connection pieces 6*f* and 6*g*, whereby the reversible unit 6 may not be mounted onto the electromagnetic contactors 1*a* and 1*b*. On the other hand, in the reversible unit 6 allowing the connection pieces 6*f* and 6*g* to be located at the normal position NP as shown in FIG. 9, the second engagement entry regulation portions 13 of the connection pieces 6*f* and 6*g* do not contact the first engagement entry regulation portions 12 of the display windows 3*a* and 3*b*, the connection pieces 6*f* and 6*g* enter the display windows 3*a* and 3*b* to be fitted to the operation display pieces 4*a* and 4*b*, and the unit bottom plate 6*a* contacts the arc-extinguishing covers 2*a* and 2*b* so that the hook portion 6*j* and the engagement hole 2*c* engage with each other, whereby the reversible unit may be mounted onto the electromagnetic contactors 1*a* and 1*b*. Then, when the connection pieces 6*f* and 6*g* are connected to the operation display pieces 4*a* and 4*b*, the second engagement entry regulation portion 13 located at the lower portion of the first engagement entry regulation portion 12 does not have any influence in a direction in which the movable contact support 4 is driven as shown in FIG. 10(*b*).

Accordingly, even in the embodiment, the first engagement entry regulation portions 12 formed in the inner walls provided with the display windows 3*a* and 3*b* and the second engagement entry regulation portions 13 protruding from the lower portions of the connection pieces 6*f* and 6*g* prevent the movement of the reversible unit 6 having the connection pieces 6*f* and 6*g* of which the initial positions are not held when the connection pieces 6*f* and 6*g* attempt to enter the display windows 3*a* and 3*b* from a position other than the normal position NP, thereby reliably preventing a state where the connection pieces 6*f* and 6*g* are not normally connected to the operation display pieces 4*a* and 4*b*.

Further, in the embodiment, since the mounting of the reversible unit 6 to two electromagnetic contactors 1*a* and 1*b* is not permitted while the connection pieces 6*f* and 6*g* of the reversible unit 6 are not normally connected to the operation display pieces 4*a* and 4*b*, the reversible electromagnetic contactor preventing an erroneous mounting of the reversible unit 6 and improving the safety may be provided.

INDUSTRIAL APPLICABILITY

As described above, the reversible electromagnetic contactor according to the invention may prevent the mounting of the reversible unit onto two electromagnetic contacts in a state where the connection piece is not properly connected to the operation display piece, and effectively prevent the erroneous mounting of the reversible unit.

EXPLANATION OF LETTERS AND NUMERALS

1*a*, 1*b*: electromagnetic contactor
2*a*, 2*b*: arc-extinguishing cover
2*c*: engagement hole

3*a*, 3*b*: display window
4: movable contact support
4*a*, 4*b*: operation display piece
6: reversible unit
6*a*: unit bottom plate
6*b*: unit cover
6*c*: first rotation plate
6*d*: second rotation plate
6*e*: rotation regulation member
6*f*, 6*g*: connection piece
6*h*, 6*i*: open portion
6*j*: hook portion
7: drive lever
8: entry regulation portion
10*a*, 10*b*: concave portion
11*a*, 11*b*: convex portion
12: first engagement entry regulation portion
13: second engagement entry regulation portion

What is claimed is:

1. A reversible electromagnetic contactor comprising:

a pair of electromagnetic contactors disposed adjacent to each other; and a reversible unit mounted over the electromagnetic contactors;

wherein the pair of electromagnetic contactors includes a movable contact support accommodated inside a body casing, and an operation display piece fixed to the movable contact support and protruding toward a display window provided in a unit mounting portion of the body casing;

the reversible unit enters a pair of connection pieces not held in the initial position to an inside of display window to respectively connect to the operation display pieces; and at least one of the electromagnetic contactors and the connection pieces includes an erroneous mounting prevention unit to permit an entry of the connection piece when the connection piece attempts to enter a normal position inside the display window connectable to the operation display piece, and to prevent the entry of the connection piece when the connection piece attempts to enter a position inside the display window deviated from the normal position.

2. A reversible electromagnetic contactor according to claim 1, wherein the erroneous mounting prevention unit is an entry regulation unit provided on a portion of the movable contact support facing the display window; and the entry regulation unit does not contact the connection piece when the connection piece attempts to enter the normal position inside the display window, and contacts the connection piece to prevent the entry thereof when the connection piece attempts to enter a position deviated from the normal position.

3. A reversible electromagnetic contactor according to claim 1, wherein the erroneous mounting prevention unit includes a concave portion provided in the movable contact support around the operation display piece and a convex portion provided at a front end of the connection piece;

when the connection piece attempts to enter the normal position inside the display window, the convex portion enters the concave portion to permit the mounting of the reversible unit onto the unit mounting portion; and when the connection piece attempts to enter a position deviated from the normal position, the convex portion contacts the movable contact support other than the concave portion to prevent the mounting of the reversible unit onto the unit mounting portion.

4. A reversible electromagnetic contactor according to claim 1, wherein the erroneous mounting prevention unit includes a first engagement entry regulation portion provided in a part of an inner wall forming the display window and a second engagement entry regulation portion provided at a front end of the connection piece to protrude outward;

when the connection piece attempts to enter the normal position inside the display window, the first and second engagement entry regulation portions do not engage with each other to permit the mounting of the reversible unit onto the unit mounting portion; and when the connection piece attempts to enter a position deviated from the normal position, the first and second engagement entry regulation portions engage with each other to prevent the mounting of the reversible unit onto the unit mounting portion.

* * * * *

UNITED STATES PATENT AND TRADEMARK OFFICE

CERTIFICATE OF CORRECTION

PATENT NO. : 8,324,994 B2
APPLICATION NO. : 13/322035
DATED : December 4, 2012
INVENTOR(S) : Yasuhiro Naka et al.

It is certified that error appears in the above-identified patent and that said Letters Patent is hereby corrected as shown below:

On the title page under item (56), line 4, FOREIGN PATENT DOCUMENTS:

Please change "JP H0-076719 3/1994" to --JP H06-076719 3/1994--.

Signed and Sealed this
Twenty-ninth Day of July, 2014

Michelle K. Lee

Michelle K. Lee
*Deputy Director of the United States Patent and Trademark Office*